United States Patent [19]

Antonious

[11] 4,126,951

[45] Nov. 28, 1978

[54] SHOE CLOSURE ASSEMBLY AND SHAWL

[76] Inventor: Anthony J. Antonious, 205 E. Joppa Rd., Towson, Md. 21204

[21] Appl. No.: 850,007

[22] Filed: Nov. 9, 1977

[51] Int. Cl.[2] ..... A43B 23/26

[52] U.S. Cl. ..... 36/54

[58] Field of Search ..... 36/50, 51, 54

[56] References Cited

U.S. PATENT DOCUMENTS

| | | | |
|---|---|---|---|
| 1,933,467 | 10/1933 | Yartyan | 36/50 |
| 2,022,554 | 11/1935 | Williams | 36/54 |
| 3,327,410 | 6/1967 | Park et al. | 36/50 X |
| 3,618,235 | 11/1971 | Cary | 36/50 |

FOREIGN PATENT DOCUMENTS

| | | | |
|---|---|---|---|
| 1,043,723 | 9/1966 | United Kingdom | 36/50 |

*Primary Examiner*—Patrick D. Lawson
*Attorney, Agent, or Firm*—Nicholas J. Aquilino

[57] ABSTRACT

A shoe having a closure assembly utilizing a hook and loop Velcro-type fastener in combination with a shawl having a second fastener to secure it to the closure assembly, both the fasteners for the closure assembly and shawl being continuously variable to provide independent control of the closure assembly tautness and shawl placement.

24 Claims, 17 Drawing Figures

FIG. 10.
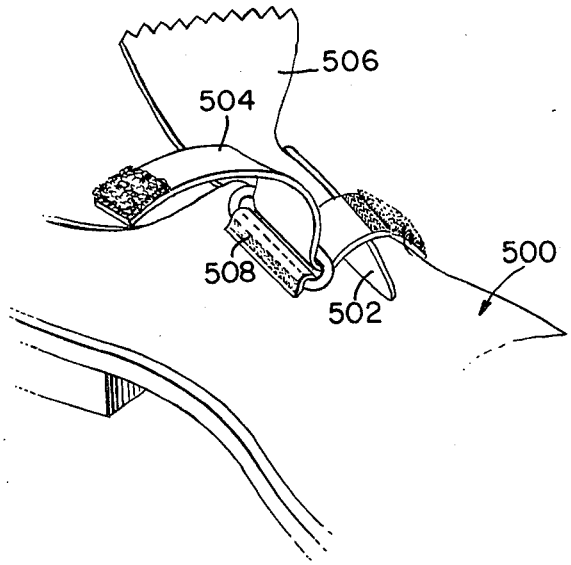
FIG. 11.
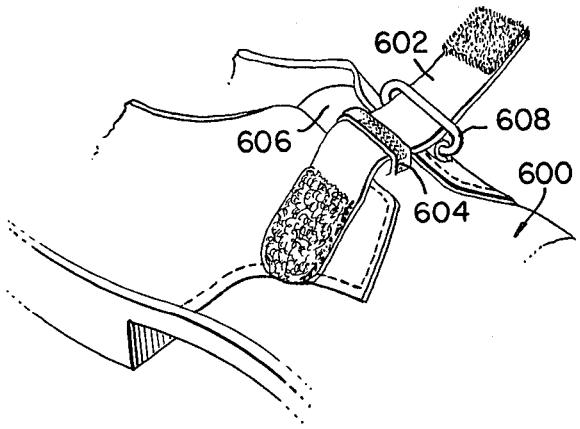
FIG. 12.
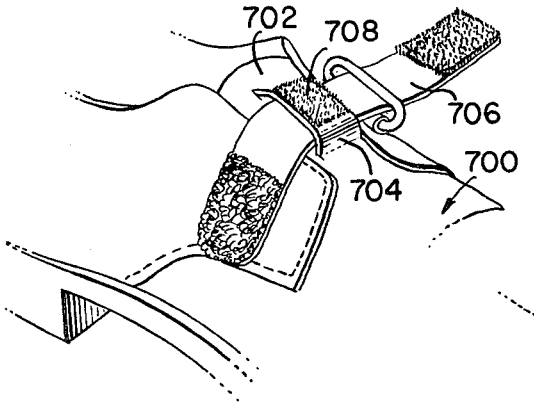
FIG. 13.
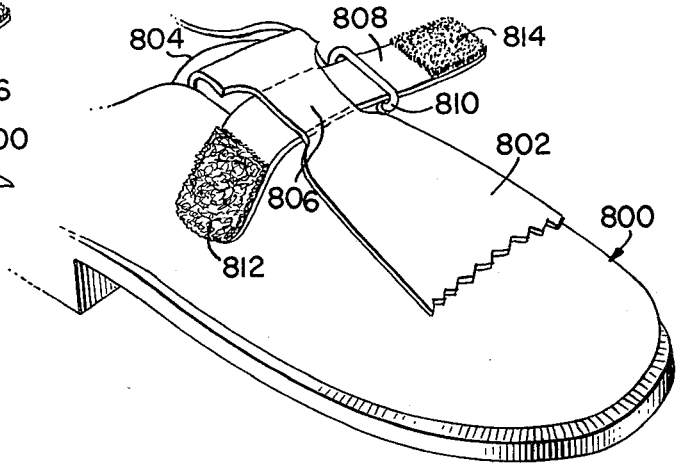
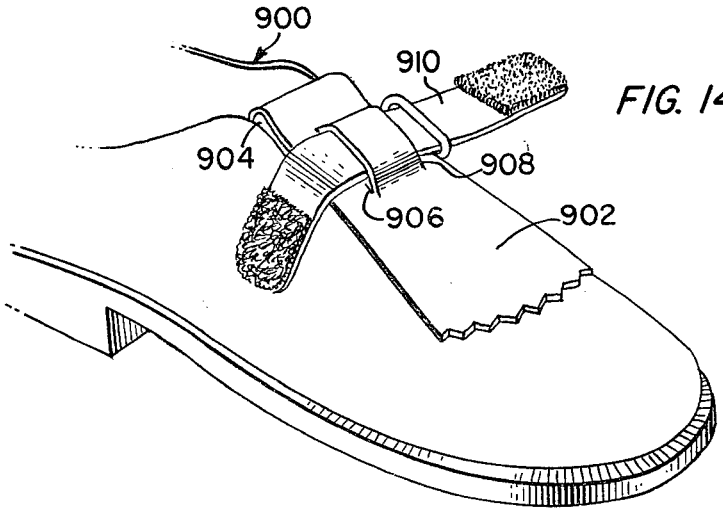
FIG. 14.

SHOE CLOSURE ASSEMBLY AND SHAWL

BACKGROUND OF THE INVENTION

The present invention relates to shoes, particularly but not exclusively to athletic type shoes, such as golf shoes or the like.

Conventional shoes are provided with laces and buckles or other rigid fasteners to act as a closure means. Each require the use of both hands to close the fastener. Laces become loose, break and have to be retied. Buckles provide limited tautness as regulated by the position of the eyelets. When a shawl is used on the conventional golf shoe, the laces must pass through the eyelets provided in the shawl so that when the laces are tied, the shawl is also held in position. Consequently, when the laces become untied, the shawl is also loosened and flops around when walking, which is annoying and distracting.

SUMMARY OF THE INVENTION

The present invention relates to shoes with improved closure means that combine the use of a closure assembly and a shawl. Preferably, both the closure assembly and shawl utilize independently controlled Velcro-type hook and loop continuously variable fastener means to provide the desired tautness when fastening the closure strap and to separately secure the shawl to the shoe.

DESCRIPTION OF THE DRAWINGS

FIG. 10 is an alternate embodiment of the type of shoe used with the subject invention.

FIG. 11 is another alternate embodiment of the type shoe used with the subject invention showing the placement of a detachable shawl.

FIG. 12 is still another alternate embodiment of the type shoe used with the subject invention showing another arrangement of the placement of a detachable shawl.

FIG. 13 is another embodiment of the type of shoe used with the subject invention showing the placement of a permanently attached shawl.

FIG. 14 is yet another embodiment of the shoe used with the subject invention showing another arrangement for the placement of a permanently attached shawl.

DESCRIPTION OF THE PREFERRED EMBODIMENTS

Figure 1:
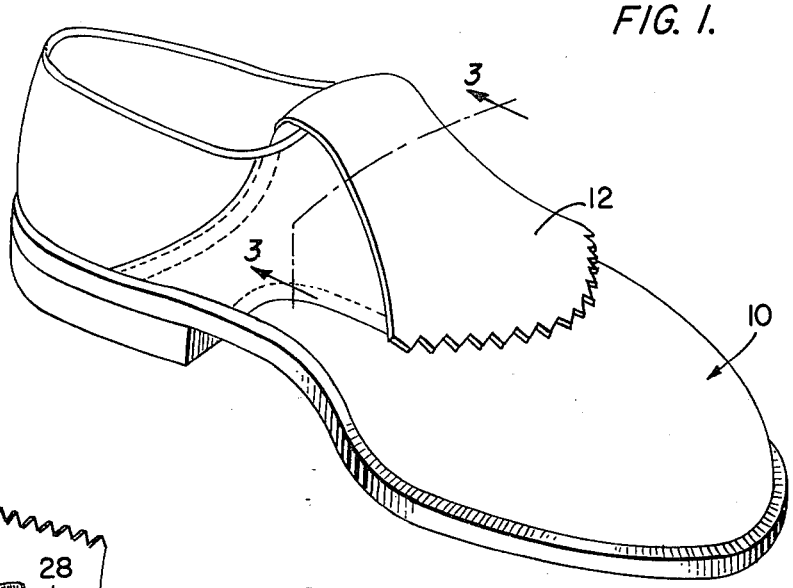
FIG. 1 is a perspective view of a shoe of the present invention with the closure strap(s) and shawl both utilizing hook and loop (Velcro) type fastener means shown in the secured position.
Figure 2:
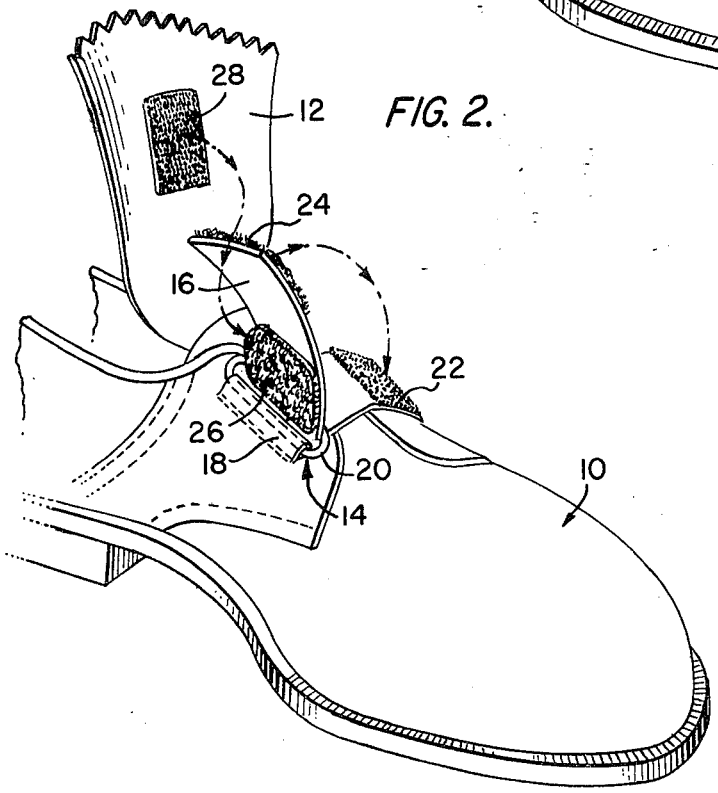
FIG. 2 is a perspective view of a first embodiment of the invention with the hook and loop (Velcro) type fastener means of the closure strap and shawl in an unfastened position.
Figure 3:
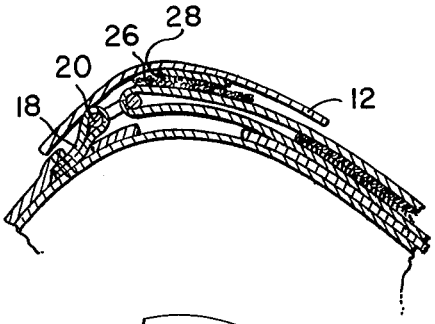
FIG. 3 is a sectional view taken along line 3—3 of FIG. 1 of the closure assembly fastener arrangement.

FIGS. 1–3 illustrate the first embodiment of the invention. A shoe, preferably a golf shoe, is shown including a shawl 12 positioned over the shoe opening and/or tongue. A closure assembly 14 consists of a strap 16 attached to one side of the shoe and an anchor strap 18 attached to the other side of the shoe. The anchor strap 18 holds a D-ring 20 sized to accommodate the strap 16 which passes therethrough to fasten the closure strap 16. The closure strap 16 includes a flexible variable (Velcro) hook and loop type fastener having a conventional hook pad 22 and a coacting loop pad 24 attached to opposite ends of the strap 16 so when the closure strap passes through the D-ring 20, it folds back upon itself and the hook and loop portions coact to fasten when pressed together.

The shawl 12 is secured by a second Velcro-type hook and loop fastening means. The top of the closure strap 16 is provided with a loop type Velcro pad 26 which faces upwardly when the strap 16 is fastened. The underside of the shawl 12 is provided with a hook type Velcro pad 28 which coacts with the loop pad 26 on the strap 16 to form the Velcro-type fastening means. The shawl 12 folds down over the shoe closure assembly 14 and is secured to the shoe when the hook and loop pads 26 and 28 are pressed together.

It will be appreciated that the hook and loop pads of either or both of the Velcro-type fasteners may be interchanged.

With this arrangement, the closure 14 bridges the opening in the shoe 10 or the anchor points of the closure assembly enabling the wearer to adjust the closure strap to the desired tautness. The closure strap and D-ring structure of the closure assembly provides a fastener which will not slip or tear open because both the hook and loop (Velcro) type pads are on the same strap member and by passing it through the D-ring, a mechanical advantage is achieved. When the shawl 12 is secured as shown, an atractive as well as functional golf shoe is accomplished.

Figure 4:
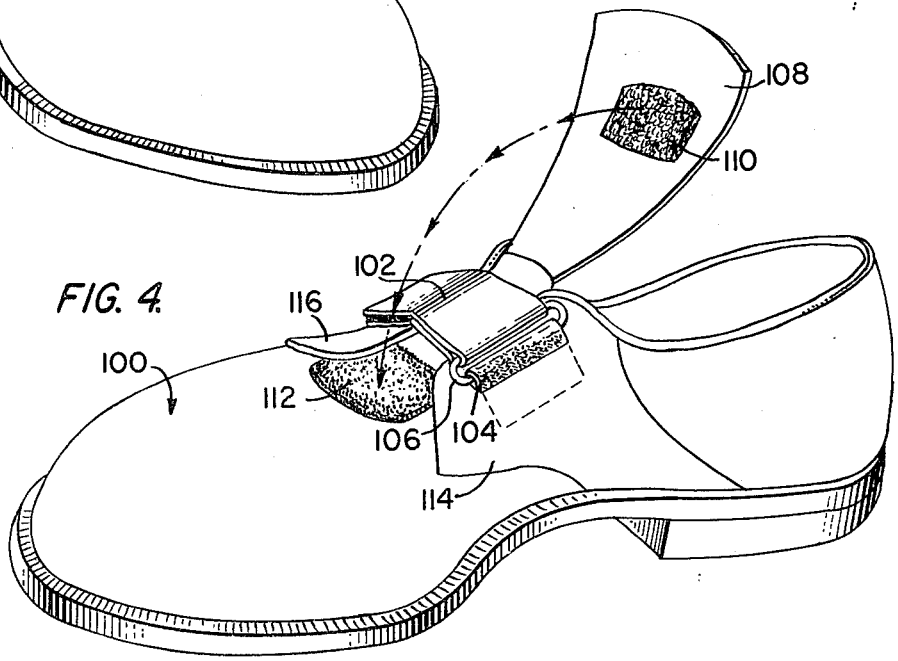
FIG. 4 is a perspective view of a second embodiment of the invention pertaining to the alternate structure of the anchor strap and the placement of Velcro-type pads for securing the shawl.

FIG. 4 illustrates a second embodiment of the shoe of the present invention. A shoe 100 is provided with a closure strap 102 having a hook and loop (Velcro) type fastener of the same type as shown in the embodiment of FIGS. 1–3. An anchor strap 104 which holds a D-ring 106 is made of resilient material or elastic. When fastened, this enables a constant yielding pull or tension on the closure strap to maintain tautness and permit a perpetual natural flexing of the foot to provide comfort and less foot fatigue.

Whereas, this particular embodiment is shown with an elastic anchor strap, it will be appreciated that this embodiment as well as all the embodiments shown in this application may be provided with either a flexible anchor strap, for example made of leather, or a resilient anchor strap, for example made of a resilient material or elastic.

The shawl 108 provides a Velcro-type fastener including a loop pad 110 attached to the underside of the shawl 10 and a hook pad 112 attached at the lower end of the tongue between the two blucher panels 114 and 116. With this arrangement, the shawl 108 folds down over the closure strap 102 and is held securely in place without being physically attached to the closure strap.

Figure 5C:
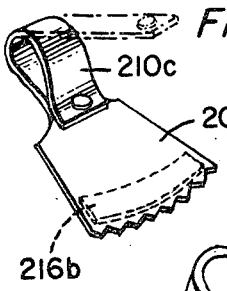
FIGS. 5A, 5B and 5C are views of alternate parts of the embodiment shown in FIG. 5 for a detachable shawl.
Figure 5:
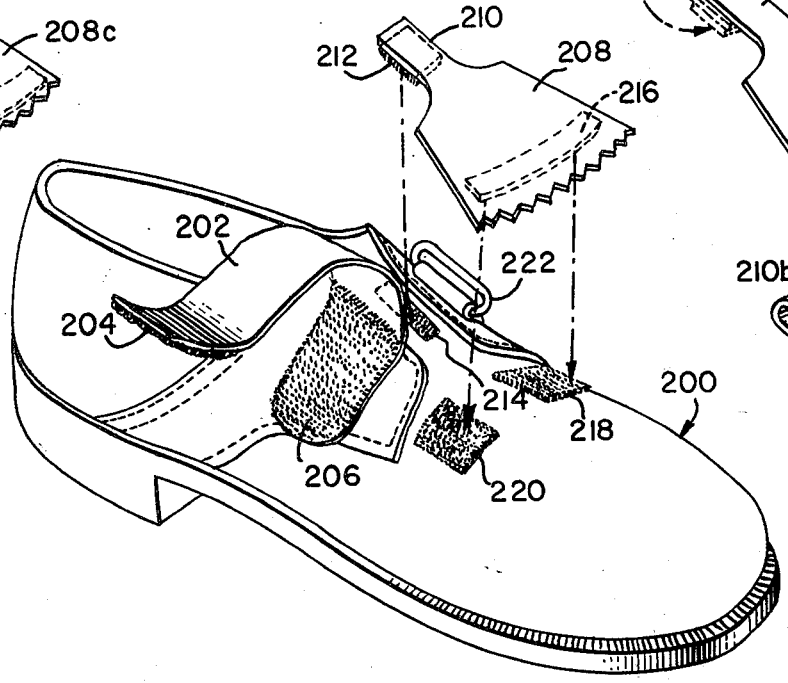
FIG. 5 is a perspective view of a third embodiment of the invention showing a detachable shawl and the placement of one or more Velcro-type fastening means to secure the shawl to the shoe.
Figure 6:
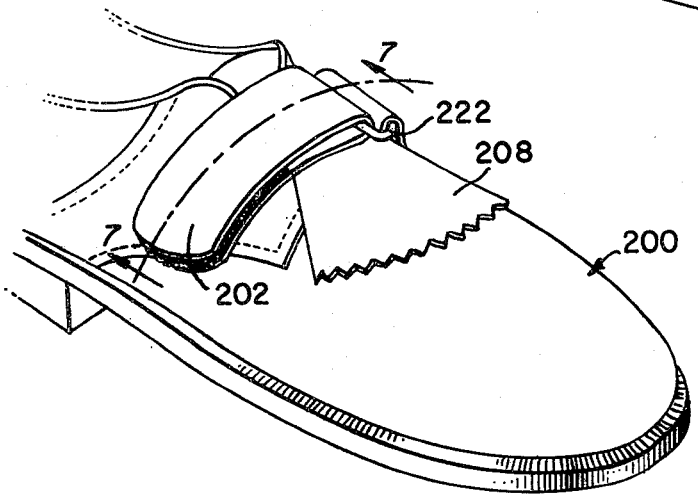
FIG. 6 is a perspective view of the embodiment of FIG. 5 with the Velcro-type fasteners in the closed position.
Figure 7:
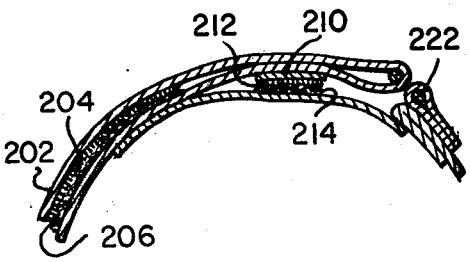
FIG. 7 is a sectional view taken on lines 7—7 of FIG. 6.

FIG. 5 shows still another embodiment of the invention. A shoe 200 is provided with a closure strap 202 having the same type Velcro fastener as disclosed in the embodiments of FIGS. 1–4 and includes a hook pad 204 and a loop pad 206. A shawl 208 is shown completely detachable from the shoe. The underside of a narrow extension 210 of the shawl 208 is first provided with a hook (Velcro) type pad 212. A loop (Velcro) type pad 214 is located on the tongue of the shoe 200 directly under the closure strap 202. A second Velcro-type fastener includes a loop (Velcro) type pad 216 on the underside of the shawl 208 at its lower end which engages one or more hook (Velcro) type pads 218 and 220. With this arrangement, the shawl 208 is secured under the closure strap 202 as shown in FIG. 6 and FIG. 7 when the strap 202 is secured by passing through a D-ring anchor 222.

Figure 5A:
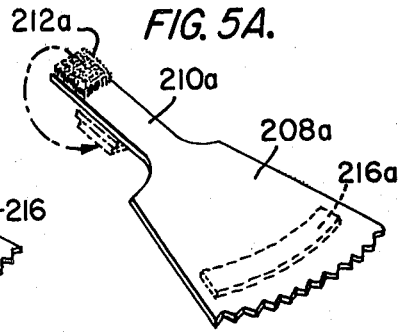

FIG. 5A shows an alternate of the shawl 208. A shawl **208*a* is provided with an extension 210*a* which is longer than the extension 210 of shawl 208. A first loop (Velcro) type pad 212*a* is attached to the top of the extension 210*a* which is designed to coact with the hook pad 214 on the shoe 200. A second loop pad 216*a* forms a fastener in the same manner as described with respect to loop (Velcro) pad 216 and hook (Velcro) pads 218 and 220. The longer extension 210*a* and the placement of the loop (Velcro) pad 212*a* enables the extension to be folded over as shown in the dotted lines of FIG. 5A, thus enabling the shawl to pass over the closure strap 202 instead of under it, in the same manner as the embodiment shown in FIG. 1**.

Figure 5B:
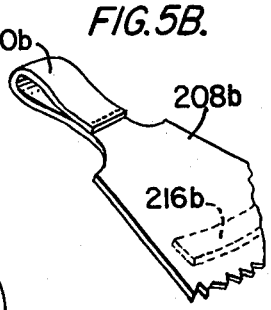

FIG. 5B shows a further embodiment of a shawl **208*b* which could be used in the embodiment shown in FIG. 5. The shawl 208*b* is formed with a fixed strap loop 210*b* without a Velcro-type fastener. The loop 210*b* fits onto the lower portion of the strap 202 and lies under the upper portion of the strap 202 when it is closed to maintain the shawl 208*b* in place. A Velcro fastener 216*b* is also provided to secure the lower portion of the shawl 208*b*** to the shoe.

FIG. 5C shows still another embodiment of the shawl **208*c* wherein the loop 210*c* is formed by a snap fastener and is used in the same manner as the embodiment of FIG. 5B**.

Either shawl **208*b* or 208*c*** may also be provided with Velcro-type fasteners under the strap loop to further secure the shawls in position.

Figure 8:
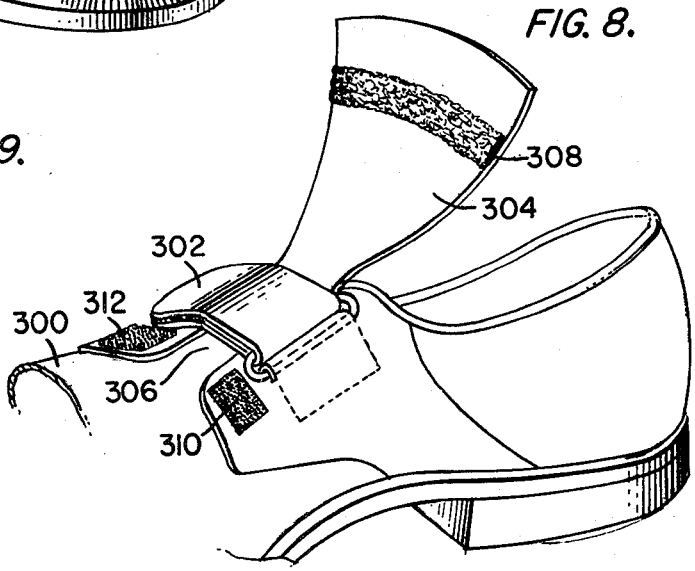
FIG. 8 is a perspective view of a fourth embodiment of the present invention pertaining to the placement of Velcro-type pads for securing the shawl to the shoe.

FIG. 8 illustrates another embodiment of the invention. A shoe 300 is provided with a closure strap 302 of the type described above. A shawl 304 is permanently attached to the tongue 306 of the shoe. The free end of the shawl 304 is secured to the shoe by utilizing a loop (Velcro) type pad 308 which is attached to the underside of the shawl 304 and coacts with one or more hook (Velcro) type pads 310 and 312 mounted on one or both blucher panels.

Figure 9:
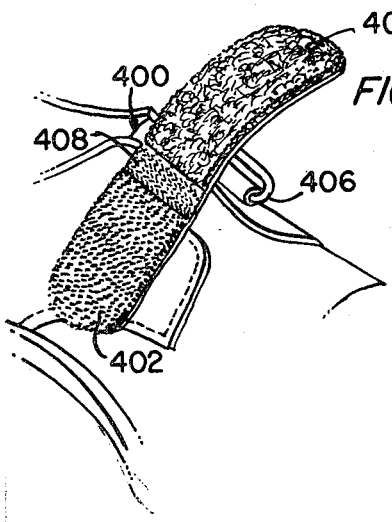
FIG. 9 is a view of an alternate structure of the closure strap utilizing elastic and Velcro-type fastener means used in the present invention.

FIG. 9 illustrates an alternate closure strap 400 having a loop (Velcro) type pad 402 and a hook (Velcro) type pad 404 which is combined with an anchor strap holding a D-ring 406 to form the closure assembly. The closure strap 400 includes a section of resilient material 408, preferably elastic, although any resilient material may be used. The closure assembly with with elastic insert may be used in place of any of the closure straps shown in the disclosed embodiments.

The closure strap with the elastic insert described in FIG. 9 or the elastic anchor strap described in FIG. 4 or any elasticized or resilient material combination thereof may be used in any of the embodiments shown to provide a closure strap which exerts a continuous pull or tautness when the closure strap is fastened.

FIG. 10 illustrates another type shoe 500 which can utilize the improved closure means and shawl of the present invention. The shoe 500 is provided with a U-throat opening 502. The strap closure 504 and shawl 506 are the same type as is used in the embodiments of FIGS. 1–3. It will be appreciated that this type of shoe 500 may be adapted to use any of the arrangements or embodiments of the present invention, as illustrated in FIGS. 1–9. In this embodiment, both the strap 504 and its anchor 508 are provided with an elastic means.

FIG. 11 shows still another arrangement for securing a detachable shawl to a shoe 600. The strap 602 is passed through a Velcro-type loop 604 which is sewn onto the tongue 606 of the shoe 600 before the strap passes through the anchor D-ring 608. A detachable shawl (not shown) having a corresponding Velcro fastener may then be secured onto the Velcro loop 604. The shawl would be further secured when the strap is folded over itself and its Velcro-type fastener is secured.

FIG. 12 illustrates one further modification for securing a detachable shawl to a shoe 700. The tongue 702 of the shoe is provided with two slots which form a loop 704 of the same type described with respect to FIG. 11 in order to receive a strap 706. The loop 704 may be provided with a Velcro fastener 708 to secure a shawl (not shown).

It will be appreciated that other attaching means may be used to secure the shawl to the shoe or closure strap including but not limited to hooks, snaps or other similar mechanical devices.

FIG. 13 shows an arrangement for securing a permanently attached shawl to a shoe 800. The shawl 802 is secured to the end of the tongue 804 of the shoe and is adapted to be folded over across the normal opening of the shoe. The shawl 802 is narrowed at 806 and is secured when the strap 808 is secured in the manner as described hereinabove by passing through a ring 810 and folding over to cause the Velcro pads 812 and 814 to fasten together. The shawl 802 then lies over the lower portion of the strap 808 and under the upper portion of the strap 808 when the strap is secured. This maintains the shawl 802 in position by clamping action of the strap.

FIG. 14 illustrates another arrangement for securing a permanently attached shawl to a shoe 900. The shawl 902 is secured to the end of the tongue 904 of the shoe and is adapted to be folded over the normal opening of the shoe. Slots 906 and 908 in the shawl 902 are adapted to receive a strap 910 as shown which secures the shawl in place when the strap 910 is secured by its Velcro-type fastener in the same manner as described hereinabove with respect to the other shoes.

As described above, either or both the anchor or the closure strap may be provided with elastic. Alternately, the Velcro fasteners themselves may be made with a degree of elasticity in order to produce the same effect of providing a continuous resilient pull on the closure assembly.

It will be appreciated that modifications may be made to the basic combination of a shoe closure strap and shawl secured by Velcro-type fasteners, and that the embodiments shown are preferred only and the scope of the invention is defined by the following claims.

What is claimed is:

1. In a shoe having an opening comprising a combination of 1. closure assembly comprising
   a. a flexible closure strap having a fixed end on one side of said opening, and a free end;
   b. anchor means on a second side of said opening adapted to receive the free end of said flexible closure strap; and
   c. hook and loop fastener means to secure said strap across said opening
2. a shawl adapted to cover said opening including retaining means cooperating with said strap for securing said shawl positioned over said opening.

2. The combination of claim 1 wherein said retaining means includes a second hook and loop fastener.

3. A shoe as recited in claim 2 wherein said strap is provided with said second hook and loop type fastener means and said anchor means includes an opening sized to receive said strap whereby said strap passes through said opening and is secured on itself with said variable hook and loop type fastener means.

4. A shoe as recited in claim 3 wherein said opening is a ring.

5. A shoe as recited in claim 1 wherein said shawl is detachable from said shoe and includes an upper and lower hook and loop type fastener for attachment to said shoe.

6. A shoe as recited in claim 2 wherein said second hook and loop type fastener is formed of at least two parts, a first part mounted on the undersurface of said shawl and a second part comprising at least one fastening means mounted on the blucher portion of said shoe.

7. A shoe as recited in claim 6 wherein said second part of said hook and loop type fastener includes a fastening means on each blucher panel opposite said opening.

8. A shoe as recited in claim 1 wherein said strap includes an elastic means for exerting a yielding pull on said strap.

9. A shoe as recited in claim 1 wherein said anchor means includes an elastic means for exerting a yielding pull on said strap.

10. A shoe as recited in claim 1 wherein both said strap and said anchor means includes an elastic means for exerting a yielding pull on each respective member.

11. The combination of claim 1 wherein said retaining means is a loop formed on said shawl through which said closure means passes to secure said shawl.

12. The combination of claim 1 wherein said retaining means is a hook and loop type fastener including a first hook and loop pile attached to the tongue of said shoe and a mating hook and loop pile on the underside of said shawl.

13. The combination of claim 12 wherein said retaining means is formed on a loop attached to said tongue.

14. The combination of claim 12 wherein said retaining means is formed on an area of said tongue defined by a pair of slots in said tongue.

15. The combination of claim 1 wherein said retainer means is said closure means.

16. The combination of claim 15 wherein said shawl includes a narrow portion which positions said closure means to retain said shawl in place.

17. In a shoe having an opening, the combination of closure assembly including a hook and loop type adjustable, multiple position, linear fastener for closing said opening, and a shawl positioned adjacent said closure means to substantially cover the opening including a second hook and loop fastener formed in two parts, a first part being formed on said closure means and a second part being formed on said shawl.

18. A shoe as recited in claim 17 wherein said first part of said fastener is mounted on the upper surface of said closure means and said second part is mounted on the underside of said shawl.

19. In a shoe having an opening, the combination of closure assembly including a hook and loop type adjustable, multiple position, linear fastener for closing said opening; and a shawl positioned adjacent said closure assembly to substantially cover said opening, said shawl being detachable from said shoe and including a second hook and loop type fastener for attachment to said shoe, said second hook and loop type fastener including (a) an upper portion formed of hook and loop type pads, a first pad on said shawl and a coating pad mounted on a tongue of said shoe in said opening located beneath the closure assembly, and (b) a lower portion formed of hook and loop type pads, a first hook and loop type pad mounted on said shoe below said opening and a second coating hook and loop type pad mounted on the underside of said shawl.

20. A shoe as recited in claim 19 wherein said shawl includes an extension to receive said upper hook and loop type fastener.

21. In a shoe having an opening, the combination of closure assembly including a hook and loop type adjustable, multiple position, linear fastener for closing said opening, and a shawl positioned adjacent said closure assembly to substantially cover the opening including a second hook and loop fastener formed in two parts, a first part being mounted in said opening of said shoe and positioned below said closure means and a second part mounted on the underside of said shawl.

22. In a shoe having an opening, the combination of closure assembly including a hook and loop type adjustable, multiple position, linear fastener for closing said opening; and a shawl positioned adjacent said closure assembly to substantially cover said opening, said shawl being detachable from said shoe and including a second hook and loop type fastener for attachment to said shoe, said second hook and loop type fastener including an upper portion formed of two parts, a first part on said shawl mounted on the topside of said shawl and foldable underneath said shawl, and a second part mounted on the tongue of said shoe in said opening located beneath said closure means and a second part mounted on the underside of said shawl.

23. In a shoe having an opening, the combination of closure means including a hook and loop type adjustable, multiple position, linear fastener for closing said opening; and a shawl positioned adjacent said closure means to substantially cover said opening wherein said shawl includes a loop which receives said closure means to retain said shawl in place.

24. In a shoe providing independent control for the combination of an improved closure means and shawl comprising a flexible closure strap having one end permanently secured to one side of the shoe;

one part of a first hook and loop type fastening means secured to one side of the shoe;

another and cooperating part of said first hook and loop fastening means permanently secured to the free end of said closure strap on the underside thereof to coact with said one part of said first hook and loop fastening means;

a flexible anchor strap permanently attached to the opposite side of said shoe which includes a ring through which the free end of said closure strap may be passed in order to double said strap back on itself to secure said parts of said first hook and loop fastening means;

a shawl with one end permanently attached to the tongue of the shoe; and a second hook and loop type fastening means having one part secured to the upper surface of said flexible closure strap and another part secured to the underside of said shawl adapted to coact with said one part of said second hook and loop fastening means on said upper surface of said flexible closure strap to secure said shawl to said closure strap.

* * * * *